United States Patent [19]

Lerch

[11] 4,451,268

[45] May 29, 1984

[54] DRY ACETYLENE GENERATOR

[76] Inventor: John A. Lerch, 139 Norvell Dr., Signal Mtn., Tenn. 37377

[21] Appl. No.: 428,486

[22] Filed: Sep. 29, 1982

[51] Int. Cl.[3] ..... C10H 3/00; C10H 21/00; C10H 21/08; C10H 21/16

[52] U.S. Cl. ..... 48/3 A; 48/4; 48/216; 48/38; 422/194

[58] Field of Search ..... 48/3 A, 3 R, 4, 216, 48/33, 38, 11; 422/273, 194, 191

[56] References Cited

U.S. PATENT DOCUMENTS

| | | | |
|---|---|---|---|
| 1,947,120 | 9/1930 | Weibezahn et al. | 48/38 |
| 2,180,085 | 11/1939 | Holler et al. | 48/33 |
| 2,701,188 | 2/1955 | Ritter et al. | 48/38 |
| 2,701,190 | 2/1955 | Ritter et al. | 48/216 |
| 3,660,225 | 5/1972 | Verreyre et al. | 162/55 |

FOREIGN PATENT DOCUMENTS

| | | | |
|---|---|---|---|
| 939224 | 2/1956 | Fed. Rep. of Germany | 48/38 |

*Primary Examiner*—S. Leon Bashore, Jr.
*Assistant Examiner*—K. M. Hastings
*Attorney, Agent, or Firm*—Alan Ruderman

[57] ABSTRACT

A multi-stage generator for generating dry acetylene gas from calcium carbide while leaving a residue of dry lime has a generator housing including a plurality of vertically spaced shelves, each shelf and its associated components providing a stage of the generator. Each shelf has an exit slot and a water spray zone circumferentially spaced therefrom. A deposit zone is formed intermediate the water spray zone and the exit slot. Stirring arms are rotatably mounted to cooperate with each shelf to sweep the calcium carbide mixture received in the deposit zone into the wetting zone and thereafter into the exit slot. The exit slot of each shelf is offset angularly relative to the exit slot of the preceeding shelf so that the calcium carbide mixture is swept about each shelf through a substantial angle prior to exiting to the next shelf.

15 Claims, 6 Drawing Figures

DRY ACETYLENE GENERATOR

BACKGROUND OF THE INVENTION

This invention relates to an apparatus and method of generating acetylene gas from calcium carbide in a multi-stage generator, and more particularly to an acetylene generator and method in which the calcium carbide is stirred and mixed with water in such a manner that new surfaces of unreacted calcium carbide are continuously exposed to the supplied water so that the lime residue is in a dry powdered state.

Acetylene gas generators most frequently used at the present time react the calcium carbide with substantially excessive water by submerging the calcium carbide in the water. The resultant residue of lime is in the form of a slurry and is removed from the generator by flushing it out with sufficient water so that it can flow through a pipe to a settling pond. The difficulty of separating the slaked lime from the water makes use of, or disposal of, the residue difficult, and in many cases impossible.

Other known prior art acetylene generators are illustrated in the following U.S. Patents:

U.S. Pat. No. 2,701,190—Ritter et al—Feb. 1, 1955

U.S. Pat. No. 2,862,805—Helig—Dec. 2, 1958

SUMMARY OF THE INVENTION

Consequently, it is a primary object of the present invention to provide a method and apparatus for generating dry acetylene gas from calcium carbide in which the lime residue may be removed in a dry state, i.e., dry lime having less than 12 percent free moisture.

It is another object of the present invention to provide a multi-stage acetylene generator in which calcium carbide is reacted with controlled quantities of water in such a manner that complete chemical reaction can occur.

It is a further object of the present invention to provide a multi-staged generator and method for continuously producing acetylene gas in which calcium carbide is continuously swept from a deposit zone in each stage through a wetting zone and continuously stirred and mixed as it continues to be swept to an exit zone for deposit into the next stage of the process until a stoichemetric quantity of water has reacted with the calcium carbide.

It is a still further object of the present invention to provide a multi-stage acetylene generator having a plurality of vertically spaced plates on which a calcium carbide mixture is deposited in seriatim, the mixture being swept from deposit zones on each plate through a wetting zone and thence to an exit zone where it drops to the next successive plate, the sweeping of the mixture acting to mix and stir the material so that the water can reach all the surfaces of calcium carbide until complete chemical reaction has occurred.

It is yet a still further object of the present invention to provide a multi-stage generator and method for continuously producing acetylene in which the acetylene and residue may be extracted from the generator without stopping the operation thereof.

Accordingly, the present invention provides an acetylene generator in the form of a vertically extending cylindrical housing, the housing having a plurality of plates mounted in axially spaced apart dispositions, each plate having an exit slot and water spray zone spaced from the slot, and associated stirring means in the form of a plurality of rotating arms for sweeping a mixture of calcium carbide deposited in a deposit zone intermediate the exit slot and water spray zone. The direction of rotation of the arms is such that the material dropping into the deposit zone is swept through the water spray zone and wetted, stirred and mixed prior to exiting through the exit slot onto the next succeeding plate. In this manner water in controlled quantities can reach all surfaces of the calcium particles until complete chemical reaction has occurred at which time the residue is conveyed to a storage bin. The sweeping of the material by the arms effects a continuous turning over and stirring of the calcium carbide with the water sprayed in the spray zones to release the acetylene gas. The disposition of the exit openings in the plates relative to the deposit zones are such that the sweeping of the material occurs through slightly less than one full rotation of the arms prior to dropping to the next stage. The exit slot of each stage is disposed above the deposit zone of the subsequent stage, i.e., the exit slots of the succeeding stages are angularly offset relatively to one another, so that the mixture may drop into the deposit zone of the next stage and be swept by the stirring arms associated therewith.

Another aspect of the invention is the provision of radially spaced material engaging pads on alternate arms of the stirring means of each stage, and double throw plow means on the other arms at a radial disposition intermediate the pads. In this manner the material is swept, stirred and churned into bands to expose the carbide material for reaction.

A further aspect of the invention includes the provision for the addition of unreacted calcium carbide to the generator, and the removal of dry lime from the generator without stopping the operation of the generator or lowering the pressure within the generator housing.

Other aspects of the invention include the provision for cooling the temperature within the generator housing and to terminate the process upon the temperature or pressure within the generator housing exceeding predetermined excessive values.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 2:
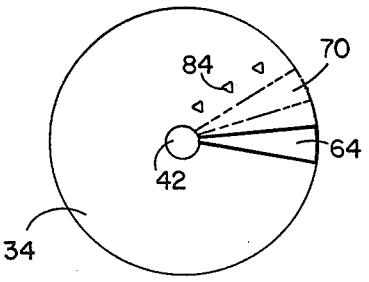
FIG. 2 is a schematic view of the top plate in the generator housing.
Figure 3:
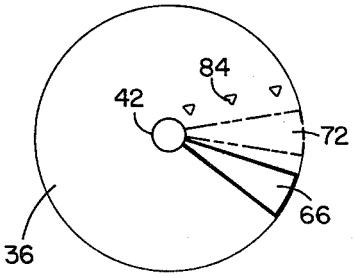
FIGS. 3 and 4 are schematic views of succeeding plates within the generator housing.
Figure 4:
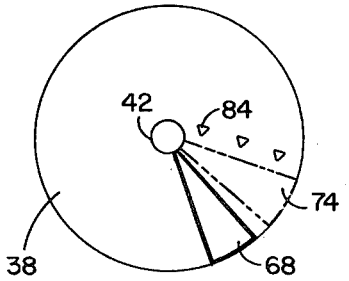
Figure 5:
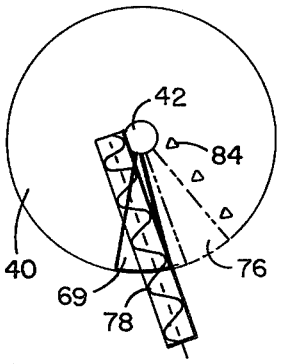
FIG. 5 is a schematic view of the bottom plate in the generator housing.
Figure 1:
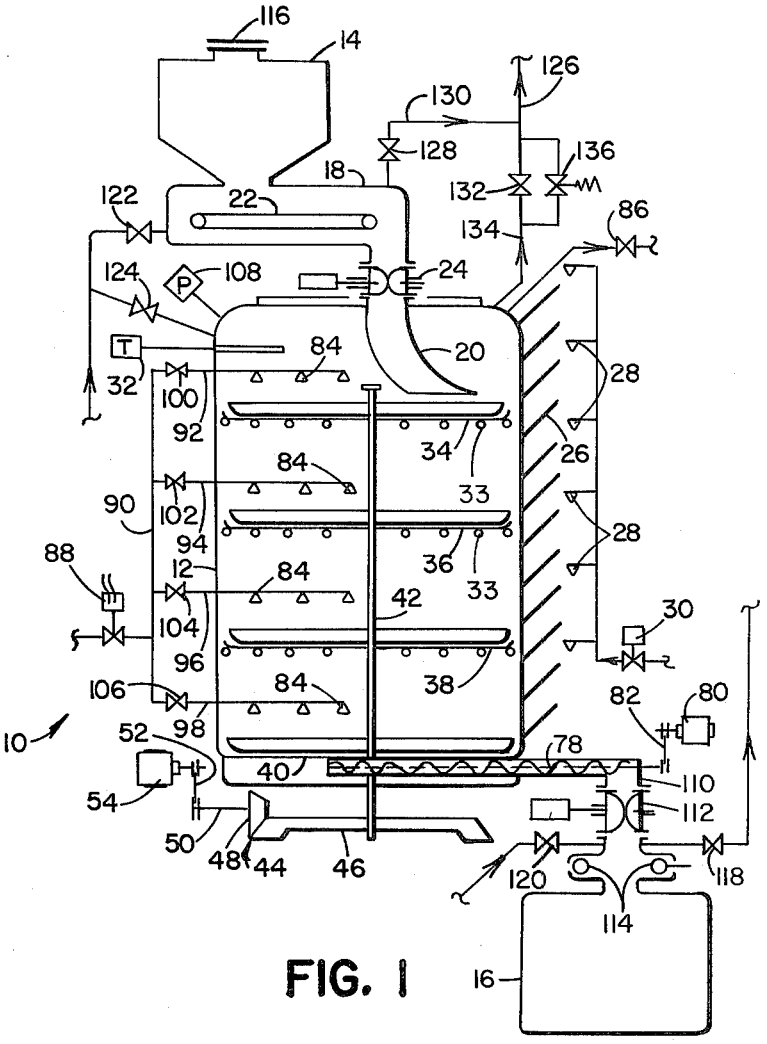
FIG. 1 is a vertical cross sectional view of an acetylene generator constructed in accordance with the present invention, illustrated in schematic form.

Referring to the drawings, and in particular to FIG. 1, a dry acetylene generator 10 constructed in accordance with the principles of the present invention generally comprises a generator housing 12 within which calcium carbide is delivered from a hopper 14 above the housing and within which acetylene is produced by the reaction of the calcium carbide with water, the dry lime residue remaining from the reaction being deposited into a receptacle or bin 16 disposed beneath the generator housing 12. The hopper 14 includes an opening at the top thereof through which a charge of calcium carbide is applied, and communicates at the bottom thereof through an inlet feed chamber 18 and a delivery chute 20 within the top of the housing 12. Disposed within the feed chamber 18 below the bottom of the hopper outlet is a belt conveyor 22 for receiving and feeding a metered amount of the calcium carbide deposited thereon to the chute 20. The conveyor 22 is preferably a variable feed unit driven by conventional drive means (not illustrated) at a pre-selected rate as determined by the capacity of the generator. Disposed within the chute 20 is a pinch valve 24, which has a resilient closure member similar to a pinch clamp, and may be driven hydraulically, or an equivalent device such as a soft vane rotary feeder or a figure eight plate may be used in lieu of the valve 24.

The housing 12 is an elongated body having a substantially circular cross sectional configuration and includes a multiplicity of vertically spaced cooling fins 26 mounted circumferentially about the outer shell of the housing. The fins 26 preferably are disposed at an upwardly inclined angle relative to the outside shell so as to form a multiplicity of substantially V-shaped troughs with the outer surface. When the temperature of the ambient air about the housing 12 is sufficiently cool for carrying off the heat due to the chemical reaction of the calcium carbide and water, the fins act as cooling vanes to maintain the temperature within the generator housing within predetermined limits. However, if the ambient temperature about the housing is relatively high, the troughs formed by the fins are filled with water supplied by spray nozzles 28 controlled by a solenoid valve 30 receiving a control signal from a thermostatic switch 32 having its sensing elements mounted within the generator housing. Moreover, water cooling coils 33 may be provided beneath the reaction stage mixture support trays hereafter described.

Mounted within the generator housing are a number of vertically spaced apart shelves or trays, and although four such trays 34, 36, 38, 40 are illustrated, it is to be understood that the number of trays provided for a given generator will depend upon the capacity of the generator. The trays are plate members capable of supporting the calcuim carbide and water mixture for purposes hereinafter described. Extending substantially centrally through each tray or plate 34–40 and journalled therein is a shaft 42 which extends out the bottom of the generator housing 12 and is rotatably driven by a rotary drive means 44. The drive means 44 may, as illustrated comprise a first bevel gear 46 journalled for rotation and connected to the shaft 42, and a second bevel gear 48 in mesh with the gear 46 and journalled on a shaft 50. The shaft 50 may be rotated by a belt and pulley drive 52 or other conventional means from a motor 54 to drive the shaft 42.

Figure 6:
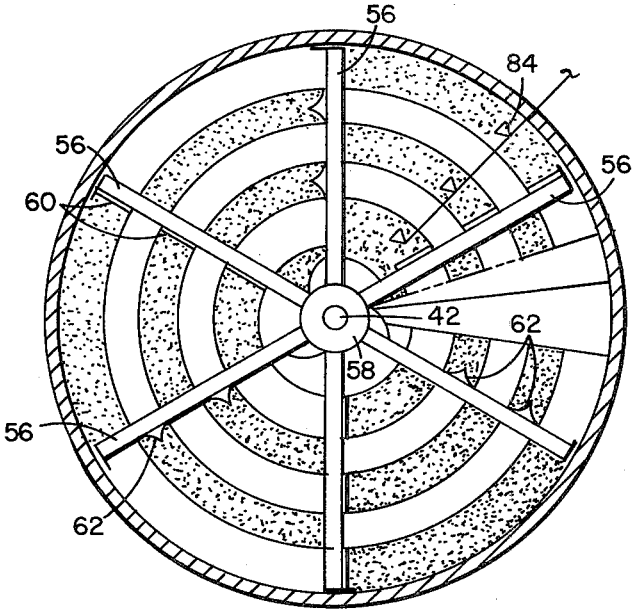
FIG. 6 is a sectional view through the generator housing illustrating the structure of a typical stage with portions thereof illustrated in schematic form.

Rigidly secured to the shaft 42 at the upper side of each tray 34–40 is a stirring means, which as illustrated in FIG. 6 preferably is in the form of a plurality of arms 56 extending in spoke-fashion from a central hub 58 fast on the shaft 42. Although six arms are illustrated, it should be understood that more or less may be utilized, and that the ideal number of arms 56 above each tray should depend upon the amount of mixing required by the texture of the calcium carbide and the size of the generator. The arms 56 are positioned relative to the respective tray 34–40 to provide a clearance space between the bottom of the arms and the upper surface of the tray so that chunks of calcium carbide will not be trapped therebetween. Disposed at radially spaced locations on alternate arms of each stirring means is a number, three being illustrated, of calcium carbide contacting pads 60 which are formed from a pliable material such as plastic, rubber or the like. The pads 60 act on the calcium carbide material as the arms rotate to deposit the material in radial substantially circular rows or bands. On the other arms, i.e., those not having the pads 60, a number of double-throw plows 62 are disposed at radial locations intermediate the pads 60 so that the calcium carbide left uninterupted by the pads is acted upon and scattered by the plows 62. The combination of the pads 60 and plows 62 will tend to shift the bands and mix the dry lower material with the wetted surface material.

Each tray has a respective radially extending sector shaped slot 64, 66, 68 and 69 formed therein. The slot in each tray 34, 36, 38, 40 is angularly offset relatively to the slot in the preceeding upper tray, i.e., circumferentially offset, so that calcium carbide material may fall through the slot to a succeeding tray only after the material is acted upon by the stirring arms of the tray. Moreover, the exit end of the chute 20 may also be sector shaped and the calcium carbide dropped from chute 20 is deposited at a location or zone on tray 34 spaced from the slot 64. The slots 64,66, 68,69 are offset upstream relative to the rotational direction of the arms 56 from the deposit zone of the chute and the preceeding trays. As illustrated the direction of rotation of the arms is counterclockwise, so the slots 64–69 are displaced clockwise of the deposit zones. Thus, the deposit zone 70 on the tray 34 is offset downstream counterclockwise of the slot 64 of the tray 34, while the deposit zone 72 on tray 36 is beneath the slot 64 and is downstream counter-clockwise of the slot 66 of tray 36, the deposit zone 74 on tray 38 due to the slot 66 of tray 36 is downstream of the slot 68, and the deposit zone 76 of the lowermost tray 40 is directly beneath the slot 68, and is downstream of the slot 69. Consequently, as the arms 56 rotate they engage the calcium carbide at the respective deposit zone and sweep it around through a substantially large portion of the respective plate before the material drops onto the next successive plate. Similarly, the arms 56 of the lowermost plate 40 sweep the material around to the slot 69 where it falls into the trough of a screw type conveyor 78 to be deposited into the bin 16 as hereinafter described. The conveyor 78 may be driven by conventional means such as motor 80 and belt and pulley drives 82.

To mix the calcium carbide with the proper amount of water so that it becomes stoichemetric prior to being discharged by the conveyor 78, each stage of the generator includes a plurality of water atomizing or spray nozzles 84 disposed in a wetting zone above the respective trays 34–40, the nozzles being offset from and downstream of the respective deposit zone 70, 72, 74, 76, i.e., displaced therefrom in the direction of rotation of the arms 56, so that the deposit zone of each tray is intermediate the corresponding wetting zone and exit slot. The amount of water sprayed at each stage is such as to dampen and react with the exposed calcium carbide surfaces to give off acetylene gas without drenching the carbide material. It is anticipated that only one set of nozzles displaced slightly from the deposit zone will be required, but it may be desired to include other sets for each stage. The arms 56 thereafter stir the mixture and as they move it to the respective slots 64, 66, 68 for depositing onto the next tray where it reacts with additional water sprayed at that stage, new surfaces of calcium carbide being continuously exposed for reaction with the water. By the time the calcium carbide exits the slot 69 and reaches the conveyor 78, a stoichemetric quantity of water has been applied to release the acetylene and provide a lime residue of less than 12 percent free moisture, the acetylene gas being drawn off to storage through a valve 86 communicating with the housing 12.

Injection of water through the spray nozzles 84 is controlled in a manner such that, as above stated, at each stage the surface of the calcium carbide is wetted but not drenched to release acetylene gas. To this end an electric solenoid valve 88 is provided in the water line leading to header 90, and the feed lines 92, 94, 96, 98 leading to the nozzles 84 of the respective trays 34, 36, 38, 40 are provided with a respective valve 100, 102, 104, 106 for throttling the water to that stage. Since there is a greater surface area to be covered in the initial stages a greater amount of water will be supplied to the upper stages than the lower stages, the exact amount and ratio between the stages being dependent upon a number of factors, such as the capacity of the generator and the number of stages. The valve 88 is electrically interlocked with a pressure activated switch 108 and either the thermostatic switch 32 or another such switch. The switch 32 (or other thermostatic switch) is also electrically interlocked with the drive means for the conveyor 22 and the motor 54 that drives the stirring means 56. Water flows to the nozzles 84 when the motor 54 and the conveyor 22 are operating and when the gas pressure within the housing 12 is below a predetermined level, which typically would be approximately 15 p.s.i., and when the temperature is below a predetermined value maintained by the water cooled vanes 26. If the pressure or temperature exceed the preselected value, the respective switch will open the circuits of the conveyor 22 and motor 54 to shut down operation of the generator and may provide a signal, such as an alarm, of this occurrence.

The dry lime received by the screw conveyor 78 is fed thereby into a duct 110 in which is mounted a hydraulically operated pinch valve 112 similar to the valve 24 or an equivalent closure device having a similar function. When the valve 112 is open, the lime drops into the bin 16 until the container is full and is thereafter replaced by an empty container. The bin 16 is coupled to the outlet of the duct 110 by a pressure seal 114 which may be a pneumatic sealing gasket that is inflatible with air to join the container to the duct 110 of the generator so as to provide a tight seal preventing escape of acetylene gas from the system. The seal 114 is disposed within the periphery of cooperating flanges of the duct 110 and the bin 16, as illustrated. A pressure tight cover 116 provided at the inlet to the hopper 14 acts to prevent escape of acetylene gas from the generator at the calcium carbide inlet end.

A number of valve controlled conduits are provided for venting the gases within the generator and for purging the system during start-up and various operations of the generator. For example, a valve 118 is provided to vent acetylene gas from the bin 16 prior to removal of a full bin, and a valve 120 is provided to admit an inert gas such as nitrogen to thereafter purge out the residual acetylene. Similar valves 122 and 124 are provided in lines communicating respectively with the inlet feed chamber 18 and the generator housing 12 to admit a purging supply of the inert gas at start-up. A vent line 126 communicates the gases within the inlet feed chamber 18 and the housing 12 respectively to a safe area, and to this end a valve 128 is inserted in the line 130 from the feed chamber 18 and a similar valve 132 is inserted in the line 134 from the generator housing. A safety relief valve 136 preferably is included in the line 134 in parallel with the valve 132 to release the pressure within the generator when it exceeds the predetermined level.

The operational features of the dry acetylene generator will now be described. Initially the pinch valves 24 and 112 are in the open state. The pressure sealed cover 116 of the hopper 14 is removed, the hopper filled with dry calcium carbide, and the cover is replaced and tightly sealed. The vent valves 118, 128, and 132 are opened. The purging valves 120, 122 and 124 are thereafter opened to admit the inert nitrogen gas to purge air from the system. When the interior atmosphere of the system is inert, the valves 120, 122 and 124 are closed. The motor 54 is thereafter energized so as to drivingly rotate the shaft 42 and the stirring arms 56 of each stage. Substantially simultaneously therewith the drive to the feed conveyor 22 is activated, the water solenoid valve 88 is energized, and the electric motor 80 is energized to initiate rotation of the screw conveyor 78.

Once the belt conveyor 22 is actuated, the calcium carbide fed thereby drops down the chute 20 and is deposited on the deposit area 70 of the initial tray 34. As the arms 56 associated with the tray 34 rotate and engage the calcium carbide it sweeps the calcium carbide from the deposit zone 70 to beneath the spray zone nozzles 84 associated with the initial tray to dampen the exposed calcium carbide. As the arms 56 continue to rotate it churns and spreads the calcium carbide in bands as determined by the disposition of the pads 60 and the plows 62 about the tray 34. When the initial calcium carbide engaging arm 56 has rotated to the disposition of the leading edge of the slot 64, the wetted calcium carbide drops through the slot 64 to the subsequent stage onto the tray 36. It should be noted that each arm 56 of the stirring means engages, sweeps and stirs a load of calcium carbide as that arm picks up its charge upon reaching the deposit zone 70, so that the process is continuous as long as calcium carbide is being fed from the hopper 14. By providing the slots 64, 66, 68 closely adjacent to the respective deposit areas 70, 72, 74 the calcium carbide in each stage is swept through a substantial portion of a full circle (as close to an entire circle as practical) before dropping to the next stage. In the case of the last stage tray 40, the same is true with regard to the disposition of the slot 69 and the screw conveyor 78 relatively to the deposit zone 76. Consequently, the water sprayed at each stage has a substantial amount of time to react with the calcium carbide continuously being exposed to release acetylene gas without drenching the calcium carbide.

As the calcium carbide drops through the respective slots 64, 66, 68 in seriatim after being wetted and swept by the arms 56 of the previous stage, it reaches the last stage by dropping onto the deposit zone 76 and is swept through the slot 69 and falls into the trough of the screw conveyor 78. By proper adjustment of the water spray at each stage, a stoichemetric quantity of water will have been reacted with the calcium carbide entering the conveyor 78. When the generator atmosphere is 100 percent acetylene, the vent valves 118, 128 and 132 are closed, and the discharge valve 86 is opened to draw off the acetylene gas to the storage means. The dry lime in the last stage is conveyed by the conveyor 78 and drops through the duct 110 into the bin 16 which is coupled to the duct 110 by the sealing means 114.

When the storage bin 16 is full, the pinch valve 112 may be activated to close off the flow of lime and to isolate the bin from the remainder of the generator. The valve 118 is opened to vent the acetylene gas in the bin to a safe area, and the valve 120 is opened to purge the residual acetylene from the space beneath the pinch valve by admission of the nitrogen or other inert gas. Once the atmosphere within the space is purged of acetylene, the pressure seal 114 is deflated to uncouple the bin 16 from the bottom of the duct 110. The full bin may then be replaced with an empty receptacle. The seal 114 is thereafter inflated to sealingly couple the new bin to the generator. The air from the empty bin is thereafter purged by admitting the nitrogen inert gas through the valve 120. The valve 120 is thereafter closed and the pinch valve 112 is opened slightly to permit acetylene to replace the inert gas by venting it out the valve 118. When the interior space is 100 percent acetylene, the vent valve 118 is closed and the pinch valve 112 is fully opened. Consequently, the lime is removed from the generator in a dry state without having to shut the operation of the generator.

When the calcium carbide inlet hopper 14 is empty and is to be refilled, a similar procedure as that used to remove the lime from the bin is utilized. The drive to the conveyor 22 is inactivated and the pinch valve 24 is closed to seal off the generator housing from the hopper. Acetylene gas is vented by opening the valve 128 and the inert gas is admitted through the valve 122 to purge the upper portion of the system. The cover 116 is removed from the top of the hopper and a new charge of calcium carbide is received. The cover 116 is thereafter closed and the atmosphere in the feed chamber 18 is purged with the inert gas. The valve 122 is thereafter closed and the inert atmosphere is replaced by acetylene by opening the pinch valve 24. When all the inert gas is vented out the vent line 126, the valve 128 is closed. Thus, the calcium carbide is added to the generator without stopping the generator.

As the temperature within the generator housing 12 increases due to the reaction of the calcium carbide and water, the thermostatic control switch 32 senses the rise in temperature of the gas. When the temperature rises above a predetermined amount the solenoid valve 30 is energized to supply water to the cooling fin/troughs 26 to maintain the temperature below an excessive amount. If the temperature continues to rise excessively, or the pressure increases beyond the preselected pressure, the temperature control switch 32 or the pressure control switch 108 respectively provide a control signal to shut down the operation of the generator, and may provide an alarming signal.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An acetylene generator for converting calcium carbide into acetylene gas and dry hydrated lime comprising a vertically extending substantially cylindrical housing, a plurality of shelves mounted in the housing in axially spaced apart disposition, stirring means associated with each shelf, each said stirring means comprising a plurality of radial arms, means for rotating the arms of each stirring means in a first direction, each shelf including a radial exit slot extending vertically therethrough, the slot in each shelf being angularly offset relatively to the slot in each adjacent shelf, water spray means disposed above each shelf for spraying a controlled amount of water onto the respective shelf at a spray zone displaced angularly in the first direction from the corresponding slot, means for depositing calcium carbide on the top shelf in a deposit zone intermediate the top shelf slot and spray zone, whereby calcium carbide deposited on the top shelf is swept by the stirring means associated therewith through and wetted by the water being sprayed thereon and the resultant mixture is subsequently swept into the top shelf slot and discharged onto the next adjacent shelf in a deposit zone intermediate the slot and the water spraying zone of said next adjacent shelf, the mixture thereafter being discharged into a deposit zone on each successive shelf in seriatim and swept by the corresponding stirring means into the respective slot, the deposit zone of each shelf being intermediate the slot and spray zone in the respective shelf, means for conveying the residue from the lowermost shelf to a lime storage bin, and means for drawing the gas to an acetylene storage means.

2. An acetelyne generator as recited in claim 1, wherein means is provided to simultaneously drive the arms of all the stirring means in said first direction, the slot in each shelf being offset slightly in the direction oppositely to said first direction relatively to the slot in the adjacent upper shelf, whereby the mixture on each shelf is swept through a maximum angle less than a full revolution of said arms.

3. An acetylene generator as recited in claim 1, wherein certain of the arms of each stirring means includes pliable pads spaced apart radially along the arms so as to sweep and mix the mixture into substantially circular bands about the corresponding shelf.

4. An acetylene generator as recited in claim 3, wherein the remaining arms of each stirring means includes double plow shaped members spaced radially intermediate said pads for scattering and mixing the mixture intermediate said bands.

5. An acetylene generator as recited in claim 1, wherein the amount of water sprayed into each shelf wets the surface of the exposed calcium carbide without drenching it, and means for providing that the total amount of water sprayed onto and mixed with the calcium carbide prior to exiting the lowermost shelf is substantially equal to the stoichemetric quantity.

6. An acetylene generator as recited in claim 1, including a multiplicity of vertically spaced fins extending about the exterior of said housing, each of said fins being upwardly inclined from the housing to define cooling troughs, and means for spraying coolant into said troughs when the temperature within said housing exceed a predetermined limit.

7. An acetylene generator as recited in claim 1, wherein said means for conveying the residue includes a lime conveyor, and a transfer duct intermediate said conveyor and said storage bin for receiving the residue from said conveyor and transferring it to the storage bin, said transfer duct having valve means for selectively closing off passage of the residue to said storage bin, means for selectively sealingly coupling and uncoupling said duct to said storage means, and means for selectively purging the atmosphere downstream of said valve means, whereby upon closing off said passageway, purging acetylene from the atmosphere downstream of said valve means, and uncoupling said duct and storage bin, lime may be removed from the generator without shutting down the generator.

8. An acetylene generator as recited in claim 7, wherein said means for selectively sealingly coupling and uncoupling said duct to said storage bin comprises an pneumatically inflatable gasket disposed between cooperating portions of said duct and said storage bin, said gasket being inflated to sealingly couple said duct and storage bin, and deflated to uncouple said duct and said storage bin.

9. An acetylene generator as recited in claim 1, wherein said means for depositing calcium carbide on the top shelf means comprises a calcium carbide conveyor, means for feeding calcium carbide to said conveyor, duct means intermediate said conveyor and said top shelf for receiving the calcium carbide from the conveyor and depositing it in the deposit zone on the top shelf, said duct means having valve means for closing off passage of the calcium carbide to said top shelf, and means for selectively purging the atmosphere upstream of said valve means, whereby upon closing off said passage and purging acetylene from the atmosphere upstream of said valve means, a new charge of calcium carbide may be supplied to said conveyor without shutting down the generator.

10. An acetylene generator as recited in claim 1, wherein each of said shelves comprises a substantially circular tray, and each slot is a substantially sector shaped portion of the corresponding tray.

11. A method of generating acetylene from calcium carbide in a plurality of stages while leaving a substantially dry lime residue, said method comprising providing a vertically extending generator having a plurality of vertically spaced shelves, depositing the calcium carbide in a deposit zone on a first shelf at the upper portion of the generator, sweeping the calcium carbide in a circular path from said deposit zone to a wetting zone, spraying water on the surface of said calcium carbide in the wetting zone, continuing to sweep the mixture of calcium carbide and water in said path to mix and permit chemical reaction of the compounds, dropping the mixture onto a shelf in the next stage prior to the mixture reaching the first shelf deposit zone, continuing the process in the subsequent stages, wherein the mixture is wetted in each stage, until a substantially dry lime residue remains, removing the residue, and removing the acetylene.

12. In the method as recited in claim 11, wherein the mixture is separated into discreet bands as it is swept in each stage.

13. In the method as recited in claim 11, wherein each stage has a deposit zone angularly offset relatively to the deposit zone of the previous stage, and a wetting zone downstream of the respective deposit zone, the steps of sweeping the mixture into the wetting zone, wetting the mixture, and sweeping the wetting mixture to an exit zone are repeated in each stage.

14. The method of generating acetylene from calcium carbide in a plurality of stages in a generator having a plurality of vertically spaced apart shelves, each shelf corresponding to a stage, while leaving a substantially dry lime residue at the exit of the last stage, each stage of said method comprising depositing calcium carbide in a deposit zone, sweeping the calcium carbide in a circular path from the deposit zone to a wetting zone, wetting the calcium carbide while continuing to sweep the material, continuing to sweep the material to an exit zone spaced in the path circumferentially from the deposit zone, and depositing the mixture in a deposit zone in the next subsequent stage.

15. In the method as recited in claim 14, wherein the total amount of water supplied in the method is a stoichemetric quantity.

* * * * *